United States Patent [19]

Schmidtke

[11] Patent Number: 4,792,325

[45] Date of Patent: Dec. 20, 1988

[54] METHOD AND APPARATUS FOR MANUFACTURING CARDBOARD PALLETS

[76] Inventor: Joachim G. Schmidtke, 1510 Horseshoe Dr., Ortonville, Mich. 48462

[21] Appl. No.: 912,468

[22] Filed: Sep. 29, 1986

[51] Int. Cl.[4] ..... B05C 1/00

[52] U.S. Cl. ..... 493/334; 493/390; 493/399; 493/438; 493/964

[58] Field of Search ..... 493/68, 69, 91, 179, 493/182, 399, 438, 446, 447, 455, 964, 71, 131, 142, 151, 276, 295, 297, 334, 357, 379, 390, 392; 108/51.3; 206/600; 156/463, 465, 477.1, 200, 204

[56] References Cited

U.S. PATENT DOCUMENTS

| | | | |
|---|---|---|---|
| 1,777,285 | 10/1930 | Adsit | 493/60 |
| 2,976,779 | 3/1961 | Hamilton et al. | 493/390 |
| 3,398,661 | 8/1968 | Mathes et al. | 493/436 |
| 3,683,822 | 8/1972 | Roberts et al. | 108/51.3 |
| 3,913,464 | 10/1975 | Flaum | 493/179 |
| 4,512,755 | 4/1985 | Stone | 493/312 |
| 4,563,377 | 1/1986 | Melli | 108/51.3 |
| 4,624,653 | 11/1986 | McBride et al. | 493/179 |

*Primary Examiner*—Frederick R. Schmidt
*Assistant Examiner*—Robert Showalter
*Attorney, Agent, or Firm*—Gifford, Groh, Sheridan, Sprinkle and Dolgorukov

[57] ABSTRACT

There is disclosed a method and apparatus for continuously making cardboard runners and stringers and assembling them into a cardboard pallet. Whether a runner or stringer is involved, the method involves essentially supplying a fiberboard blank of appropriate composition and size, running the blank through a perforating and scoring roller to produce fold lines in the blank, and progressively folding the blank from the outside in, by passing it through a plurality of curvilinear rods, and applying adhesive to portions of the blank during the folding process. The runners and stringers thus produced are assembled together to form a cardboard pallet.

10 Claims, 4 Drawing Sheets

Fig-1
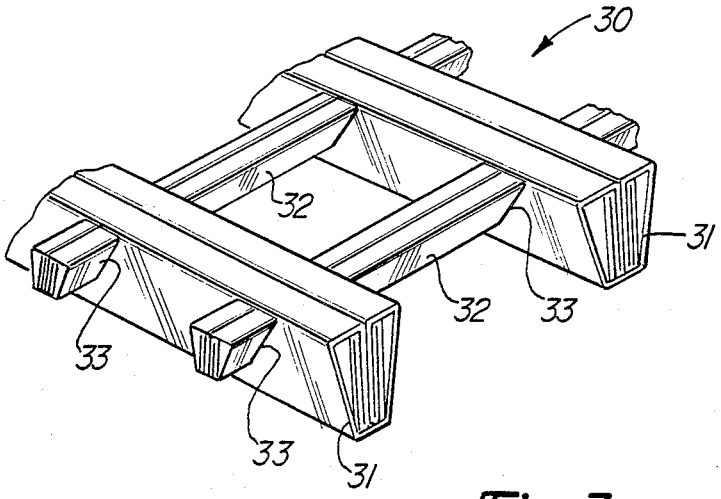
Fig-2
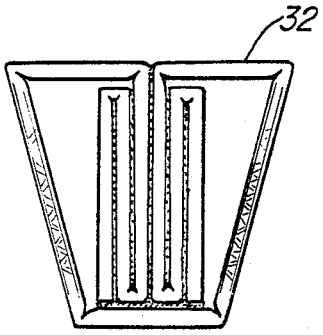
Fig-3
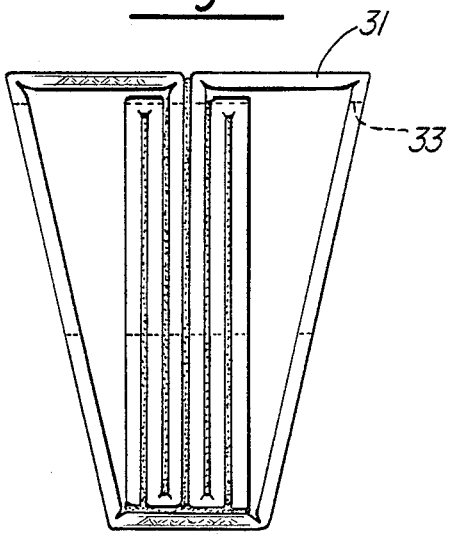
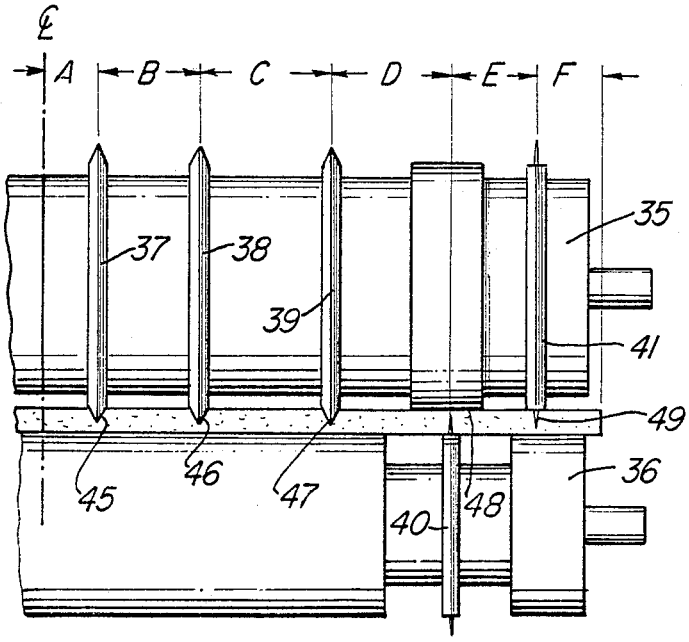
Fig-5

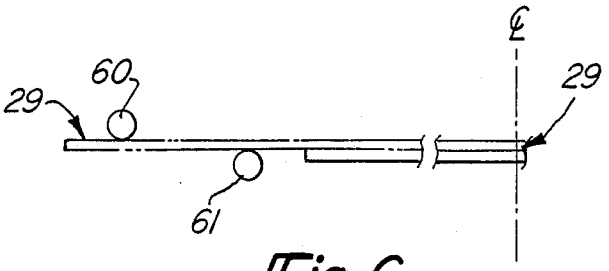
Fig-6
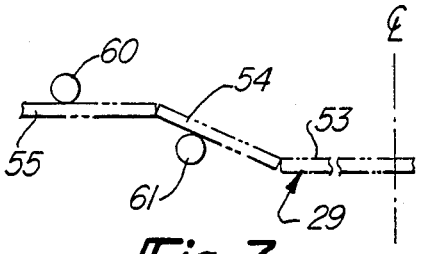
Fig-7
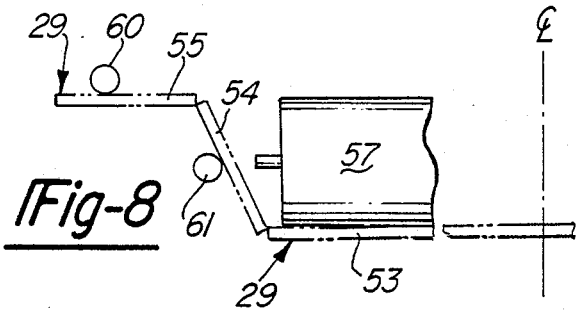
Fig-8
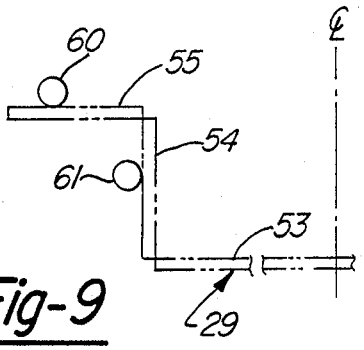
Fig-9
Fig-10
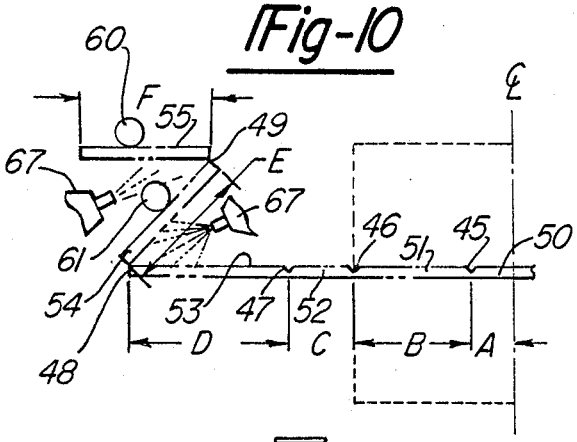
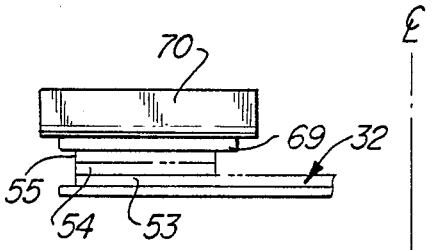
Fig-11
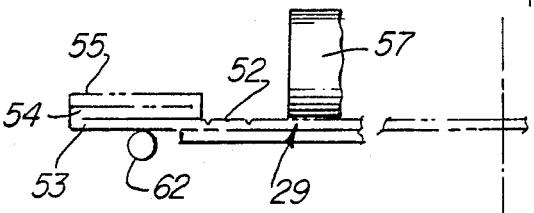
Fig-12
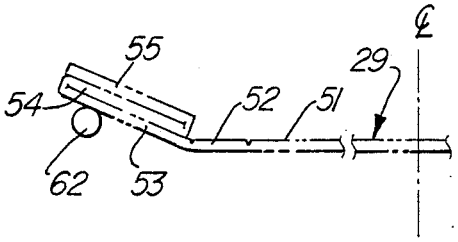
Fig-13
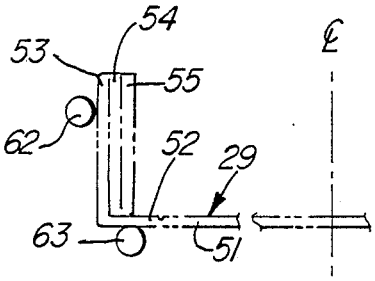
Fig-14

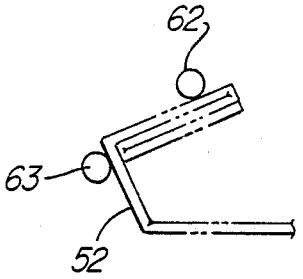
Fig-15
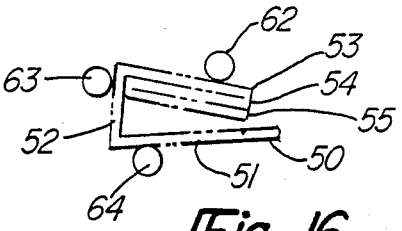
Fig-16
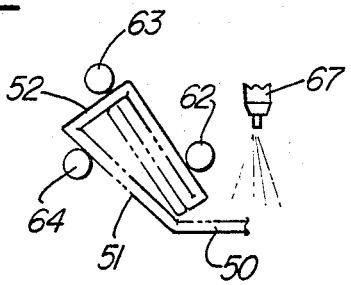
Fig-17
Fig-17A
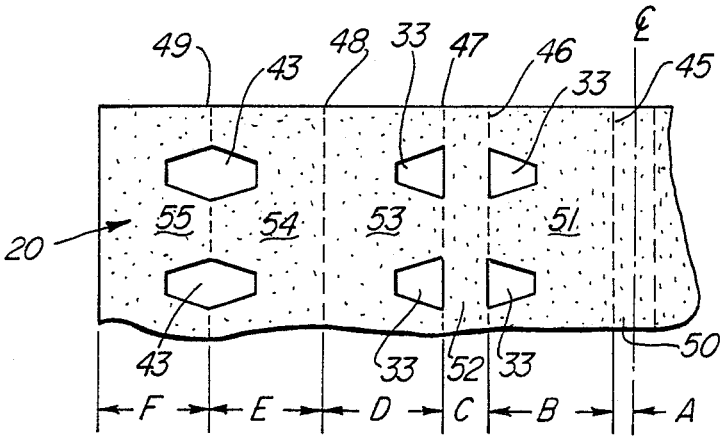
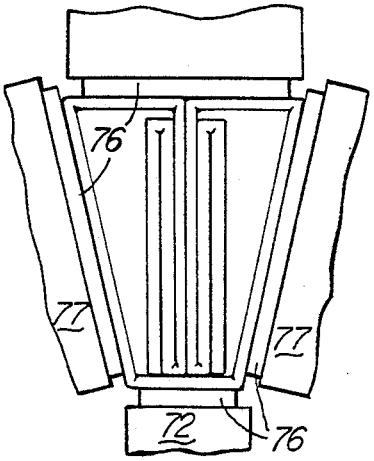
Fig-18
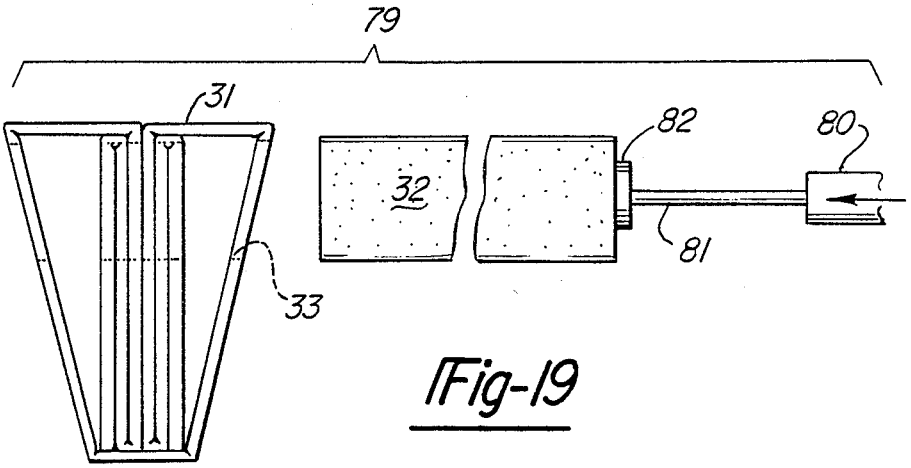
Fig-19

METHOD AND APPARATUS FOR MANUFACTURING CARDBOARD PALLETS

BACKGROUND OF THE INVENTION

1. Field of the Invention

The present invention relates to pallet making machinery, and more particularly to a continuous method and apparatus for making cardboard runners and stringers and assembling them into a cardboard pallet.

2. Description of the Prior Art

Prior to the advent of the present invention, the stringers and runners used in cardboard pallets were made in a series of discontinuous operations. While the blanks used to make the runners and stringers were scored in a similar manner, the folding operations involved numerous stops and starts as the stringers and runners were folded along each fold line by machines using what is commonly referred to as a "monkey motion". This process took substantially longer than the process disclosed in the present invention, and thus was time consuming and uneconomical, and did not lead to widespread use of cardboard pallets in industry because of their expense. The present invention, by using a continuous process, is able to make cardboard pallets much more cheaply, solve long standing problems in the art, and promote the use and adoption of such cardboard pallets.

SUMMARY OF THE INVENTION

The method used in manufacturing a cardboard pallet according to the present invention involves making a series of runners and stringers using essentially the same appartus and series of steps, and assembling these into a cardboard pallet at the end of the process. Whether a runner or a stringer is involved, the first step is essentially to supply a fiberboard blank of the appropriate composition and size, and to run this blank through a perforating and scoring means, usually a pair of rollers, to perforate and score the blank in the appropriate location. If a stringer is involved, since these must have openings for the runners to pass through, holes will be punched in the blank by the perforating and scoring means. As the blank continues past the perforating and scoring means, it encounters continuous curvilinear rod means which fold and glue the blanks into runners and/or stringers in what is essentially the shape of an inverted truncated pyramid, and when they are finished, a predetermined number of runners will be inserted into the openings in a predetermined number of stringers, in a friction fit engagement, to form a cardboard pallet.

Thus, it is an object of the present invention to provide an improved method for making a cardboard pallet.

A further object of the present invention is to provide an improved appartus for practicing the foregoing method.

A further object of the present invention is to provide a continuous manufacturing process for making cardboard pallets.

A still further object of the present invention is to provide that the runners and stringers are made by a continuous process.

A still further object of the present invention is to provide an economical method for manufacturing a cardboard pallet using commonly available materials.

Further objects and advantages of the present invention will be apparent from the following description and appended claims, reference being made to the accompanying drawings forming a part of the specification, wherein like reference characters designate corresponding parts in the several views.

BRIEF DESCRIPTION OF THE DRAWINGS

FIG. 1 is a partial perspective view of a cardboard pallet constructed according to the method and apparatus of the present invention.

FIG. 2 is an elevational view of one of the runners shown in FIG. 1.

FIG. 3 is an elevational view of one of the stringers shown in FIG. 1.

FIG. 5 is an elevational view of one half of one of the perforating and scoring rollers shown in FIG. 4.

FIG. 6 is a partial sectional view, taken in the direction of the arrows, along the section line 6—6 of FIG. 4.

FIG. 7 is a partial sectional view, taken in the direction of the arrows, along the section line 7—7 of FIG. 4.

FIG. 8 is a partial sectional view, taken in the direction of the arrows, along the section line 8—8 of FIG. 4.

FIG. 9 is a partial sectional view, taken in the direction of the arrows, along the section line 9—9 of FIG. 4.

FIG. 10 is a partial sectional view, taken in the direction of the arrows, along the section line 10—10 of FIG. 4.

FIG. 11 is a sectional view, taken in the direction of the arrows, along the section line 11—11 of FIG. 4.

FIG. 12 is a partial sectional view, taken in the direction of the arrows, along the section line 12—12 of FIG. 4.

FIG. 13 is a partial sectional view, taken in the direction of the arrows, along the section line 13—13 of FIG. 4.

FIG. 14 is a partial sectional view, taken in the direction of the arrows, along the section line 14—14 of FIG. 4.

FIG. 15 is a partial sectional view, taken in the direction of the arrows, along the section line 15—15 of FIG. 4.

FIG. 16 is a partial sectional view, taken in the direction of the arrows, along the section line 16—16 of FIG. 4.

FIG. 17 is a partial diagrammatic sectional view, taken in the direction of the arrows, along the section line 17—17 of FIG. 4, and showing an adhesive applicator.

FIG. 17A is a partial sectional view, taken in the direction of the arrows, along the section line 17A—17A of FIG. 4.

FIG. 18 is a partial plan view of a stringer before the folding operations shown in FIGS. 4–17, and showing the openings therein which are necessary to allow the insertion of the runner after the manufacturing operation.

FIG. 19 is a diagramatic view showing how the runners are inserted into the stringers to form a cardboard pallet.

Figure 4:
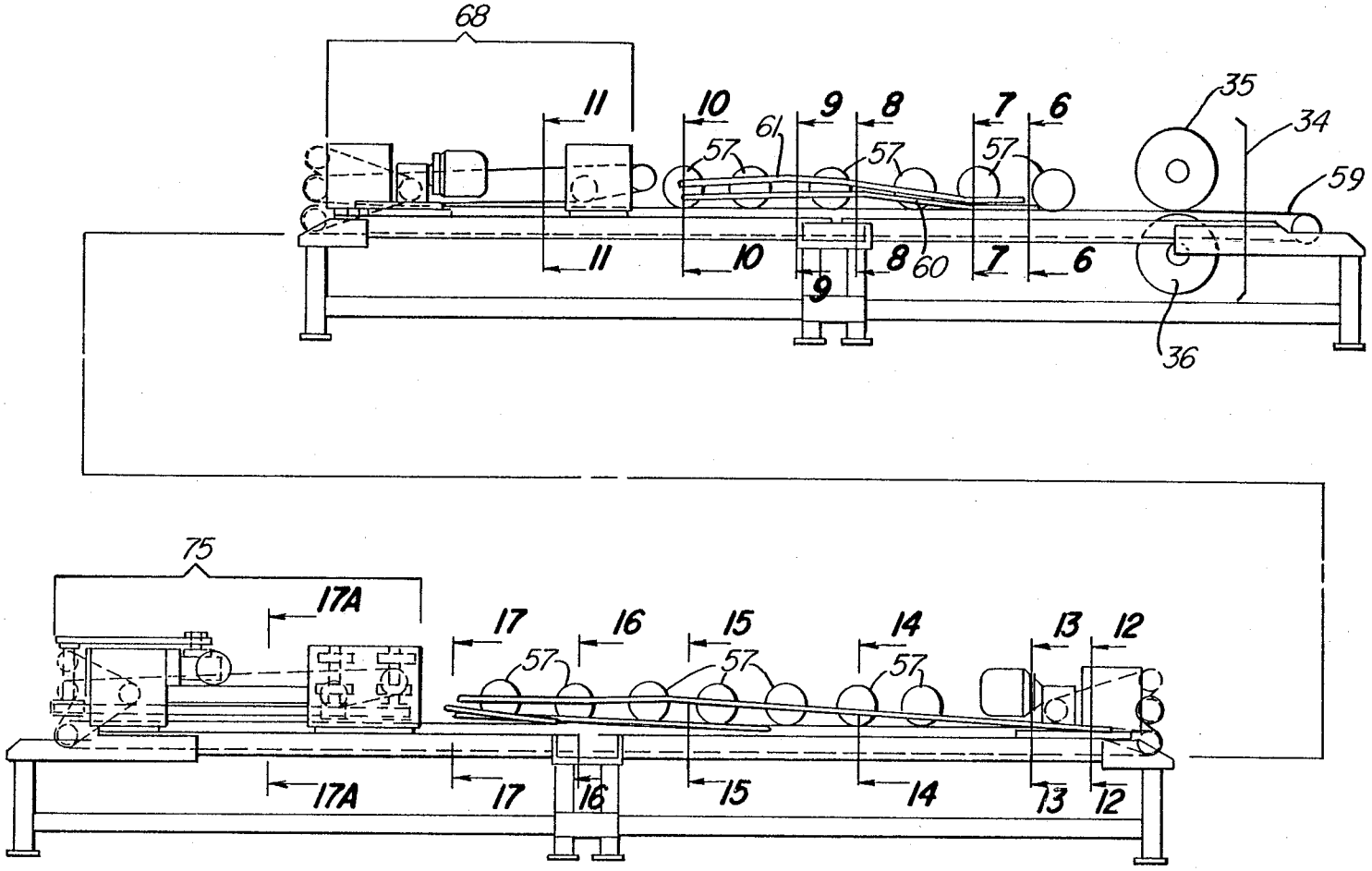
FIG. 4 is an elevational view of an apparatus constructed in accordance with the present invention.

It is to be understood that the present invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

DESCRIPTION OF THE PREFERRED EMBODIMENT

Referring now to FIGS. 1–3, there is shown a cardboard (fiberboard) pallet 30 constructed according to the method and apparatus of the present invention. Typically such a pallet will consist of a number of runners 32 and stringers 31 at right angles to each other. The number of runners and stringers in a pallet may vary depending upon the particular application to which the pallet is to be put, but in a typical construction made according to my invention, there are three runners and three stringers at right angles to each other.

As can be seen by FIGS. 2 and 3, the runner 32 and the stringer 31 are essentially of the same construction, with the stringer 31 being taller and of greater width to accomodate the insertion of the runners 32 into the openings 33 provided in the stringer 31.

As can be seen by referring to FIGS. 10 and 18, the runners and stringers first start out as flat cardboard pieces, and through a continuous series of folding and gluing operations are made into stringers 31 and runners 32 which are then assembled, as in FIG. 1, to make the finished pallet.

Since the manufacture of the stringers 31, and the runners 32 are nearly identical, the manufacture of the runner 32 will be described first. For ease of illustration only one half of the piece of the fiberboard blank, generally designated by the numeral 29, from which the runner is being made, is shown in FIGS. 6–17, it being understood that a mirror image of what is shown will appear on the opposite side of the center line shown in the drawing.

The size of the cardboard (fiberboard) blank 29 being used to make the runner will vary depending on the size of the pallet being made. A typical runner length is 36 inches long, and to make such a runner one would typically start with a blank 17 and $\frac{7}{8}$ of an inch wide.

Referring to FIGS. 4, 5, and 10, the blank 29 would be passed through a perforating and scoring means 34 consisting of an upper perforating and scoring roller 35 and a lower perforating and scoring roller 36, with attendant operating means. On the roller are mounted a first scoring wheel 37 a distance A from the center line, a second scoring wheel 38 a distance of A+B from the centerline, a third scoring wheel a distance of A+B+C from the center line, a first perforating wheel 40 a distance of A+B+C+D from the center line, and a second perforating wheel a distance of A +B+C+D+E from the center line.

It is to be noted that the first perforating wheel 40 is part of the lower perforating and scoring roller 36, while all the remaining wheels are part of the upper perforating and scoring roller 35. It is to be noted that these rollers are constructed to provide support under or above the respective scoring or perforating wheel where needed.

In the typical runner being described, the distance A would be nine sixteenths of an inch, the distance B would be two inches, the distance C would be one and one sixteenth of an inch, the distance D would be one and three sixteenths of an inch, and the distance E would be one and three quarters of an inch, with the distance F in this instance being identical to the distance E. This operation would place mark scores at the points labeled 45, 46 and 47 and perf scores at the points marked 48 and 49. For ease of explanation, I shall refer to the point 45 as the first fold line, the point 46 as the second fold line, the point 47 as the third fold line, the point 48 as the fourth fold line, and the point 49 as the fifth fold line. It should be noted that the fourth fold line is on the underside of the runner 42 while the first, second, third and fifth fold lines are on the top of the blank. As stated before, an exact mirror image of these fold lines will appear on the other side of the center line shown in FIGS. 5 and 10, as well as in FIGS. 6–9 and 11–17.

It can be seen that after the blank 29 passes through the the perforating and scoring means 34, it will have formed thereon a first panel of width 2A, a pair of second panels of width B, a pair of third apnels 52 of width C, a pair of fourth panels 53 of width D, a pair of fifth panels 54 of width E, and a pair of sixth panels 55 of width F. Having passed through the perforating and scoring means 34, the blank continues in the direction of the arrows through the apparatus shown in FIG. 4. At section line 6—6 the blank 29 encounters its first pressure roller 57 of a series of substantially identical pressure rollers which are intended to hold the blank 29 down while a series of rod means fold the various pannels from outside to inside in a manner to be illustrated.

Generally, the pressure rollers 57 are of sufficient weight to hold the blank 29 against the surface of the belt 59 which is proceeding in the linear direction, and because of the friction produced, causes the blank 29 to move through the rollers with the belt 59. The belt means 59, together with the pressure rollers 57 form the means to move the blank 29 through the apparatus of the present invention. The roller 57 can be spring loaded, or have increased tension applied in a number of ways known in the art, if desired. Generally as the portion of the blank which is left unfolded becomes smaller, the width of the pressure rollers decreases.

At the section line 6—6 of FIG. 4, the blank 29 encounters a first curvilinear rod means directly above its top surface and a pair of second curvilinear rod means directly below its top surface. Such first curvilinear rod means in the present embodiment of the invention comprise a pair of first curvilinear rods 60 mounted symetrically on each side of the belt 59. Likewise said second curvilinear rod means comprise a pair of second curvilinear rods 61.

As the blank 29 moves from Section 6—6 to Section 7—7 of FIG. 4 (see FIGS. 6 and 7) the pair of first curvilinear rods 60 and the pair of second curvilinear rods 61 increase in elevation, causing the pair of fifth panels 54 on the blank 29 to assume a slight slope, while the pair of sixth panels 55 remain horizontal because of the constraining effect of the pair of first curvilinear rod means 60.

As the blank 29 progresses to section 8—8 of FIG. 4 (see FIGS. 7 & 8) the pair of first curvilinear rods 60 and the pair of second curvilinear rods 61 have increased in elevation quite substantially, thus causing the pair of fifth panels 54 to assume quite a slope, while the pair of sixth panels 55 still remain horizontal because of the constraining effect of the first curvilinear rods 60.

As the blank 29 proceeds to section 9—9 of FIG. 4, it can be seen that the elevation of the first curvilinear rods 60 has stayed the same. While the elevation of the second curvilinear rods 61 has stayed the same, they have moved inwardly, causing the pair of fifth panels to assume a vertical direction, while the sixth panels, and the fourth panels, remain horizontal because of the constraining effect of the pressure roller 57.

In FIG. 10 the first adhesive application takes place. The elevation of the first curvilinear rods 60 and the second curvilinear rods 61 has again stayed constant, but both rods have moved further toward the center of the blank 29, causing the fourth pannels 53, the fifth panels 54, and the sixth panels 55 to form a pair of "z" shaped configurations while moving toward section 10—10 of FIG. 4. At this point, a pair of spray heads 67 applies adhesive to the lower surface of the sixth panels 55, the upper and lower surfaces of the fifth panels 54 and the upper surface of the fourth panel 53. As the blank moves to section 11—11 of FIG. 4 it encounters a curing means 68 in the form of a curing belt 69 with a backing shoe 70 which keeps the subassembly formed thus far under pressure for a sufficient length of time for the adhesive to dry.

It should be understood that for economy and ease of manufacture, a hot glue such as Henkel, Bordens or Fuller is preferred for use in the process. The particular glue would be chosen depending on the application the finished runner was to be put to. A cold glue could also be used if desired for particular applications. This could not be sprayed on, but instead, gluing heads (not shown) would have to be provided continuously along the path of the blank 29 in place of the spray heads 57, which would considerably increase the cost of the apparatus of the present invention. Also, immediately in front of the curing means 68 it would be necessary to add heat lamps to heat the cold glue to speed its drying. Because of all these additional factors, a hot glue is preferred. However, it is contemplated that some of the newer "instant" cyanoacrylate glues might also be suitable for use in the process of the present invention, and these also would not require heat lamps, and may not require the curing means 68.

As the blank 29 emerges from the curing means 68 and proceeds to section 12—12 of FIG. 4, a third curvilinear rod means consisting of a pair of third curvilinear rods 62 are encountered as shown in FIG. 12, and by this time the sixth panel, the fifth panel, and the fourth panel are securely glued to each other. The third curvilinear rods 62 at this point are just supporting this combination.

However, as the blank moves toward section 13—13 of FIG. 4, the third curvilinear rods increase in elevation, causing this combination to assume a sloped position, and as it proceeds to Section 14—14 of FIG. 4, the third curvilinear rods 62 come inwardly, causing this subassembly to assume a vertical position. At this point, the blank 29 also encounters a fourth curvilinear rod means consisting of a pair of fourth curvilinear rods 63.

As the blank proceeds past section 15—15 of FIG. 4 (see FIG. 15) the third curvilinear rods 62 move essentially inwardly, while the fourth curvilinear rods 63 move upwardly and inwardly, causing third panel 52 to be folded inwardly. This process continues as the blank 29 proceeds to section 16—16 of FIG. 4 (see FIG. 16), at which time the sixth panel 55 actually is touching the second panel 51 proximate the first fold line 45 and the remaining surface of the sixth panel 55.

Immediately past section 17—17 of FIG. 4, the folding process is completed, and the completed runner 32 enters a second curing means 75 having a plurality of second curing belts 76 with second backing shoes 77, and continues to move through the curing means until all the adhesive is dry. As before, the type of adhesive which is preferred is a hot glue, but the comments previously made as to the cold glue and "instant" glue also apply to this stage in the method, and if a cold glue is used gluing shoes would be provided, and curing lamps (not shown) would be added to the second curing means 75 immediately before the second curing belt 76 contacted the runner 32.

This completes the method of making the runner. The method of making the stringer is identical, except that openings 33 must be provided in the stringer 31. Because of the particular folding of the stringer 31, double openings 43 must be provided in certain places. As before, the size of the stringer will vary depending upon the particular application. However as can be seen by referring to FIG. 18, and comparing the same with FIG. 10, the operations are exactly identical. In this case, for a typical stringer 31 dimension A is thirteen sixteenths of an inch, dimension B is five and thirteen sixteenths of an inch, dimension C is two and one sixteenth of an inch, dimension D is five and seventeen thirty seconds of an inch, dimension E is five and eleven thirty seconds of an inch, and dimension F is five and seven sixteenths of an inch, for a total of twenty five inches on each side of the center line. The first second and third mark scores, and thus the first, second and third fold lines, are again indicated by the numerals 45, 46 and 47 respectively while the first perf score (fourth fold line) and the second perf score (fifth fold line) are indicated by the numerals 48 and 49 respectively. In this case the dimensions of the perf scores for the stringer are a quarter inch cut and a quarter inch land, where on the runner they were a $\frac{1}{8}''$ cut and a $\frac{3}{8}''$ land. Again there will be a first panel 50, a pair of second panels 51, a pair of third panels 52, a pair of fourth panels 53, a pair of fifth panels 54, and a pair of sixth panels 55. All of the operations just described in FIGS. 6 through 17A are identical, except the size of the apparatus is slightly bigger to accomodate the stringers 31, which are themselves larger than the runners 32. After the stringers 31 and runners 32 are made, they are placed in an assembly means generally designated by the numeral 79, a portion of which is shown in FIG. 19. Typically three stringers 31 will be placed in a jig means and have three runners 32 force fit into the openings 33 in the stringers 31. This may be done manually, or if desired, power assisted equipment may be provided, such as the hydraulic cylinder 80 having reciprocating shaft means 81 with a pressure plate 82 mounted on the end thereof. Typically said assembly means 79 would include a jig means to hold three stringers 31 in a spaced apart, parallel, stationary relationship. Likewise, three runners 32 would be held in guide means orthagonal to the stringers 31, and aligned with the openings 33. When the stringers 31 and runners 32 are in position, a plurality of hydraulic cylinders 80 would activate the recipricating shaft means 81 to have the pressure plates 82 apply pressure at one end of the stringers 32, and the shaft means 81 would extend and force the runner 32 into the openings 33 in the stringers 31 for a predetermined distance. Since a force fit is involved, when the runners 32 are in the desired position, the shaft means 81 would retract and the manufacture of the cardboard pallet according to the method of the present invention would be complete. It should be understood that the runners 32 may be in an other than orthogonal relationship with the stringers 31 if desired.

Thus by abandoning old methods of cardboard pallet manufacture, involving a discontinuous processes, long standing problems in the art have been solved.

I claim:

1. A method of making a cardboard pallet including the steps of:

(a) manufacturing a plurality of stringers having openings therein to receive a runner using a continuous process including the steps of:

(i) perforating and scoring a blank at a number of predetermined positions to provide a predetermined series of fold lines, and openings therein, (ii) progressively folding said blank at fold lines by moving said blank past a plurality of curvilinear rod means, (iii) applying adhesive to said blank at predetermined areas while said blank is being folded, and (iv) curing said adhesive, (b) manufacturing a plurality of runners for insertion into said stringers using the steps of:

(i) perforating and scoring a blank at number of predetermined positions to provide a predetermined series of fold lines, (ii) progressively folding said blank at said fold lines by moving said blank past a series of curvilinear rod means, (iii) applying adhesive to said blank at predetermined areas while said blank is being folded, and (iv) curing said adhesive, (c) inserting said runners into said openings in said stringers to form said cardboard pallet.

2. A method of making a cardboard pallet, said method including the steps of:

(a) scoring a cardboard blank at a number of predetermined positions to form a first panel, a pair of second panels, a pair of third panels, a pair of fourth panels, a pair of fifth panels, and a pair of sixth panels on said blank while advancing said blank in a longitudinal direction through a perforating and scoring means, (b) utilizing said perforating and scoring means to perforate said blank to provide openings therein, which will, when said stringer is complete, accept the insertion of runners therein, (c) continuing to advance said blank in a longitudinal manner, (d) utilizing a first curvilinear rod means and a second curvilinear rod means to fold said forth panels, said fifth panels and said sixth panels into a pair of substantially "z" shaped configurations, (e) applying adhesive to the underside of said sixth panels, both sides of said fifth panels, and the top side of said fourth panels, (f) continuing to utilize said first and said second curvilinear rod means to complete the folding of said sixth panels onto said fourth panel, thus forming a pair of subassemblies consisting of said sixth, said fifth and said fourth panels, (g) curing the construction formed thus far, (h) utilizing a third, a fourth, and a fifth curvilinear rod means to fold said subassemblies of said sixth, said fifth and said fourth panels over onto said second panels, all while advancing said blank in a longitudinal manner, (i) applying adhesive to the top of said first panels and said sixth panels, (j) completing the folding over of the subassembly of said sixth panels, said fifth panels, and said fourth panels until said fourth panels are in contact with each other, thus forming a stringer, and (k) curing the stringer.

3. The method defined in claim 2, and including the additional steps necessary to make a runner for insertion into said stringer, said steps including, (a) scoring a cardboard blank at a number of predetermined positions to form a series of panels on said blank while advancing said blank in a longitudinal direction through a perforating and scoring means.

4. The method defined in claim 3, wherein said series of panels include:

(a) a first panel (b) a pair of second panels (c) a pair of third panels (d) a pair of fourth panels (e) a pair of fifth panels (f) a pair of sixth panels.

5. The method defined in claim 4, and including the additional steps of:

(a) continuing to advance said blank in a longitudinal manner, (b) utilizing a first curvilinear rod means and a second curvilinear rod means to fold said forth panels, said fifth panels and said sixth panels into a pair of substantially "z" shaped configuratons, (c) applying adhesive to the underside of said sixth panels, both sides of said fifth panels, and the top side of said fourth panels, (d) continuing to utilize said first and said second curvilinear rod means to complete the folding of said sixth panels onto said fourth panel, thus forming a pair of subassemblies consisting of said sixth, said fifth and said fourth panels, (e) curing the construction formed thus far, (f) utilizing a third, a fourth, and a fifth curvilinear rod means to fold said subassemblies of said sixth, said fifth and said fourth panels over onto said second panels, all while advancing said blank in a longitudinal manner, (g) applying adhesive to the top side of said first panels and said sixth panels, (h) completing the folding over of said subassemblies of said sixth panels, said fifth panels, and said fourth panels until said fourth panels are in contact with each other; thus forming a runner, and (i) curing the runner.

6. The method defined in claim 5, and including the steps of:

(a) providing an assembly means to hold a plurality of stringers in a parallel fixed relationship ready to receive a plurality of runners in said openings in said stringers (b) providing a means to hold said runners in position for insertion into said stringers (c) providing means to insert said runners into said stringers, and (d) causing the insertion of said runners into said stringers, thereby forming a pallet.

7. A method of making a fiberboard pallet, said method including the steps of:

(a) forming a plurality of stringers by:

i. providing fiberboard blanks suitable for scoring and perforation, ii. passing said blanks through a perforating and scoring means to produce longitudinally scored fiberboard blanks with openings therein to accept a runner when said stringer is completely formed, iii. utilizing continuous rod means to progessively fold, from the outside in, said fiberboard blanks along said score lines, and iv. applying adhesive to pre-determined portions of said blanks, and curing said glue, all while folding said blanks, to produce a symmetrical construction, thereby producing a plurality of stringers, and (b) forming a plurality of runners by:

i. providing fiberboard blanks suitable for scoring and perforation, ii. passing said blanks through a perforating and scoring means to produce longitudinally scored fiberboard blanks, iii. utilizing continuous rod means to progressively fold, from the outside in, said fiberboard blanks along said score lines, and iv. applying adhesive to pre-determined portions of said blank, and curing said adhesive, all while folding said blank to produce a symmetrical construction, thereby forming a plurality of runners, and (c) inserting said runners into said stringers in an orthogonal, press fit, relationship thereby forming a pallet.

8. A machine for the manufacture of cardboard pallets, said machine including:

(a) a perforating and scoring means, including means to perforate fiberboard blanks to provide openings therein, said perforating and scoring means also including a pair of scoring rollers of the type adapted to make mark scores and perf scores, (b) means to move said fiberboard blanks through and past said perforating and scoring rollers in a longitudinal direction, thereby scoring said fiberboard blanks and providing fold lines therein, said means to move including:

(i) at least one belt means, (ii) means to move said belt in a longitudinal direction; and (iii) rotatable pressure roller means adapted to apply pressure to said fiberboard blanks while they are on said belt means so that they will be secure while they are being operated on by a curvilinear rod means, (c) curvilinear rod means disposed along the path of travel of said blanks to fold said blanks progressively, from the outside in, along said fold lines, until a symmetrical construction is formed, said rod means including:

(i) a first curvilinear rod means including a pair of first curvilinear rods, (ii) a second curvilinear rod means including a pair of second curvilinear rods disposed symmetrically about said belt means, (iii) a third curvilinear rod means including a pair of third curvilinear rods disposed down-stream of said first and said second curvilinear rod means and disposed in a symmetrical relationship about said belt means, (iv) forth curvilinear rod means including a pair of forth curvilinear rods disposed symmetrically about said belt means proximate said third curvilinear rod means (v) a fifth curvilinear rod means including a pair of fifth cirvilinear rods disposed in a symmetrical relationship about said belt means proximate said forth cirvilinear rods, (d) means to apply adhesive to preselected portions of said blank while said folding operation is taking place in a manner to secure said symmetrical construction, (c) means to cure said adhesive; and

9. The machine defined in claim 8, wherein said means to apply said adhesive includes:

(a) a plurality of spray heads mounted at predetermined positions along said belt means proximate said curvilinear rod means, (b) an adhesive holding reservoir, and (c) a conduit connecting said adhesive holding reservoir with said spray heads, and (d) means to propel said adhesive from said reservoir to said spray heads.

10. The machine defined in claim 9 wherein said means to cure said adhesive include heat lamps where necessary, and (a) a plurality of belts and belt shoes to hold said fiberboard blanks in position while said adhesive is curing.

* * * * *

UNITED STATES PATENT AND TRADEMARK OFFICE
CERTIFICATE OF CORRECTION

PATENT NO. : 4,792,325

DATED : December 20, 1988

INVENTOR(S) : Joachim G. Schmidtke

It is certified that error appears in the above-identified patent and that said Letters Patent is hereby corrected as shown below:

Col. 4, line 13, delete "the" second occurrence;
line 15, delete "apnels" and insert --panels--;
Col. 5, line 7, delete "pannels" and insert --panels--;
Col. 7, line 48, delete "forth" and insert--fourth--;
Col. 8, line 64, delete "i." and insert --(i)--;
line 66, delete "ii." and insert --(ii)--;
Col. 9, line 3, delete "iii." and insert --(iii)--;
line 6, delete "iv." and insert --(iv)--;
line 13, delete "i." and insert --(i)--;
line 15, delete "ii." and insert --(ii)--;
line 18, delete "iii." and insert --(iii)--;
line 21, delete "iv." and insert --(iv)--;
Col. 10, line 30, delete "(c)", and insert --(e)--;
line 31, insert --(f) means to assemble a fiber-

UNITED STATES PATENT AND TRADEMARK OFFICE

CERTIFICATE OF CORRECTION

PATENT NO. : 4,792,325

DATED : December 20, 1988

INVENTOR(S) : Joachim G. Schmidtke

It is certified that error appears in the above-identified patent and that said Letters Patent is hereby corrected as shown below:

board pallet from the symmetrical constructions so produced. --.

Signed and Sealed this

Tenth Day of October, 1989

*Attest:*

DONALD J. QUIGG

*Attesting Officer*

*Commissioner of Patents and Trademarks*